US007607940B2

(12) United States Patent
Ikeya et al.

(10) Patent No.: US 7,607,940 B2
(45) Date of Patent: Oct. 27, 2009

(54) WATERPROOF CONNECTOR

(75) Inventors: Kenichi Ikeya, Shizuoka-ken (JP); Yasuhiro Sasaki, Shizuoka-ken (JP); Tsuneyuki Takahashi, Atsugi (JP); Takahiro Yoneda, Atsugi (JP); Ryo Sawada, Atsugi (JP); Ken Yoshimura, Atsugi (JP); Nozomi Ito, Tochigi-ken (JP)

(73) Assignees: Yazaki Corporation, Tokyo (JP); Calsonic Kansei Corporation, Tokyo (JP)

( * ) Notice: Subject to any disclaimer, the term of this patent is extended or adjusted under 35 U.S.C. 154(b) by 18 days.

(21) Appl. No.: 11/661,921

(22) PCT Filed: Sep. 5, 2005

(86) PCT No.: PCT/JP2005/016224

§ 371 (c)(1),
(2), (4) Date: Oct. 5, 2007

(87) PCT Pub. No.: WO2006/028033

PCT Pub. Date: Mar. 16, 2006

(65) Prior Publication Data

US 2008/0194131 A1 Aug. 14, 2008

(30) Foreign Application Priority Data

Sep. 6, 2004 (JP) ..... 2004-258786

(51) Int. Cl.
*H01R 13/73* (2006.01)

(52) U.S. Cl. ..... 439/559

(58) Field of Classification Search ..... 439/559, 439/557, 556, 364
See application file for complete search history.

(56) References Cited

U.S. PATENT DOCUMENTS 6,575,787 B2 * 6/2003 Ishikawa et al. ..... 439/587

FOREIGN PATENT DOCUMENTS

| | | |
|---|---|---|
| JP | 05-258800 | 10/1993 |
| JP | 5-87844 | 11/1993 |
| JP | 10-92510 | 4/1998 |
| JP | 2002-141137 | 5/2002 |
| JP | 2002-184516 | 6/2002 |

* cited by examiner

*Primary Examiner*—Phuong K Dinh
(74) *Attorney, Agent, or Firm*—Finnegan, Henderson, Farabow, Garrett & Dunner, L.L.P.

(57) ABSTRACT

A waterproof connector, comprising a pair of male and female housings (30, 40) engaged with each other. The waterproof connector also comprises a grommet (10) covering at least one of the housings (30, 40) and a fastening member (50) inserted from the grommet (10) side into the pair of male and female housings (30, 40) to connect them to each other. In addition, the grommet comprises a sealing part (12) having a predetermined length along the inserting direction of the fastening member (50) and formed integrally with a grommet body (11) at the outlet side end part (14) thereof.

2 Claims, 3 Drawing Sheets

WATERPROOF CONNECTOR

TECHNICAL FIELD

The present invention relates to a waterproof connector having a housing covered with a grommet.

BACKGROUND OF ART

This kind of waterproof connector is disclosed in Patent document No. 1. In this waterproof connector, a male housing and a female housing in pairs are inserted into a mounting panel from its front and back sides respectively and further engaged with each other. In arrangement, the female housing is covered with a grommet so that its clinch part surrounds an overhang part formed on an upper part of the housing on the front side and a grommet lip part comes into contact with the back surface of the female housing. A waterproof projection is formed on the upper part of the male housing to project to the front side of the mounting panel. When the female housing and the male housing are connected to each other, the waterproof projection is brought into contact with the downside of the overhang part, so that both the clinch part and the lip part operate as a crank-like seal between the female housing and the male housing, improving an effect to prevent droplets via the mounting panel from entering into the grommet.

Patent Document No. 1: Japanese Patent Laid-Open Publication No. 10-92510

DISCLOSURE OF THE INVENTION

In the conventional waterproof connector, however, since the respective housings are connected with each other by a bolt (a fastening member) inserted from a side of the grommet and the waterproofing property is ensured due to a repulsive force of the grommet to the bolt, there is the possibility that if a grommet tube part (a grommet body) in the form of a bellows is pulled in the processes of attaching the connector to the mounting panel and wiring a harness, a grommet cylindrical part stretches to produce a gap between the cylindrical part and the bolt,-causing water droplets to enter an interior of the grommet through the gap.

In order to solve the above-mentioned problem, an object of the present invention is to provide a waterproof connector that does not deteriorate its waterproof performance between a fastening member and a sealing part despite that a grommet body is pulled.

In order to accomplish the above object, in an aspect of the present invention, there is provided a waterproof connector comprising: a first connector housing; a second connector housing fitted to the first connector housing; a grommet configured to cover at least one of the first connector housing and the second connector housing; and a fastening member which is inserted from a side of the grommet to connect the first connector housing with the second connector housing, wherein the grommet is formed with a predetermined length along the inserting direction of the fastening member and includes a sealing part formed integrally with the grommet at a grommet's part into which the fastening member is to be inserted.

According to the above aspect of the present invention, since the grommet is formed with a predetermined length along a direction to insert the fastening member and includes a sealing part formed integrally with the grommet at a grommet's part into which the fastening member is to be inserted, even if the grommet body is pulled in the processes of wiring the harness and attaching the waterproof connector, the inlet side end part is maintained as being sealed up, excluding the possibility that the waterproofing performance deteriorates.

Further, the sealing part may be provided, on an outer peripheral part thereof, with an extension part that absorbs a tension when the grommet is pulled.

According to the above constitution, owing to the provision of the extension part on the outer peripheral part of the sealing part, even if the grommet is pulled in this waterproof connector, such a pulling has less effect on the sealing part since the extension part operates to absorb the pulling. Consequently, the inlet side end part, is maintained as being sealed up, excluding the possibility that the waterproofing performance deteriorates.

Still further, at least one of the first connector housing and the second connector housing may be provided with an engagement part and further, the sealing part may be provided, on an outer peripheral part thereof, with a catching part for engagement with the engagement part.

According to the above constitution, since the engagement part is engaged with the catching part in this waterproof connector, even if the grommet body is pulled in the processes of wiring the harness and attaching the waterproof connector, the sealing part is maintained as being sealed up, excluding the possibility that the waterproofing performance deteriorates.

BEST MODE FOR CARRYING OUT THE INVENTION

Figure 1:
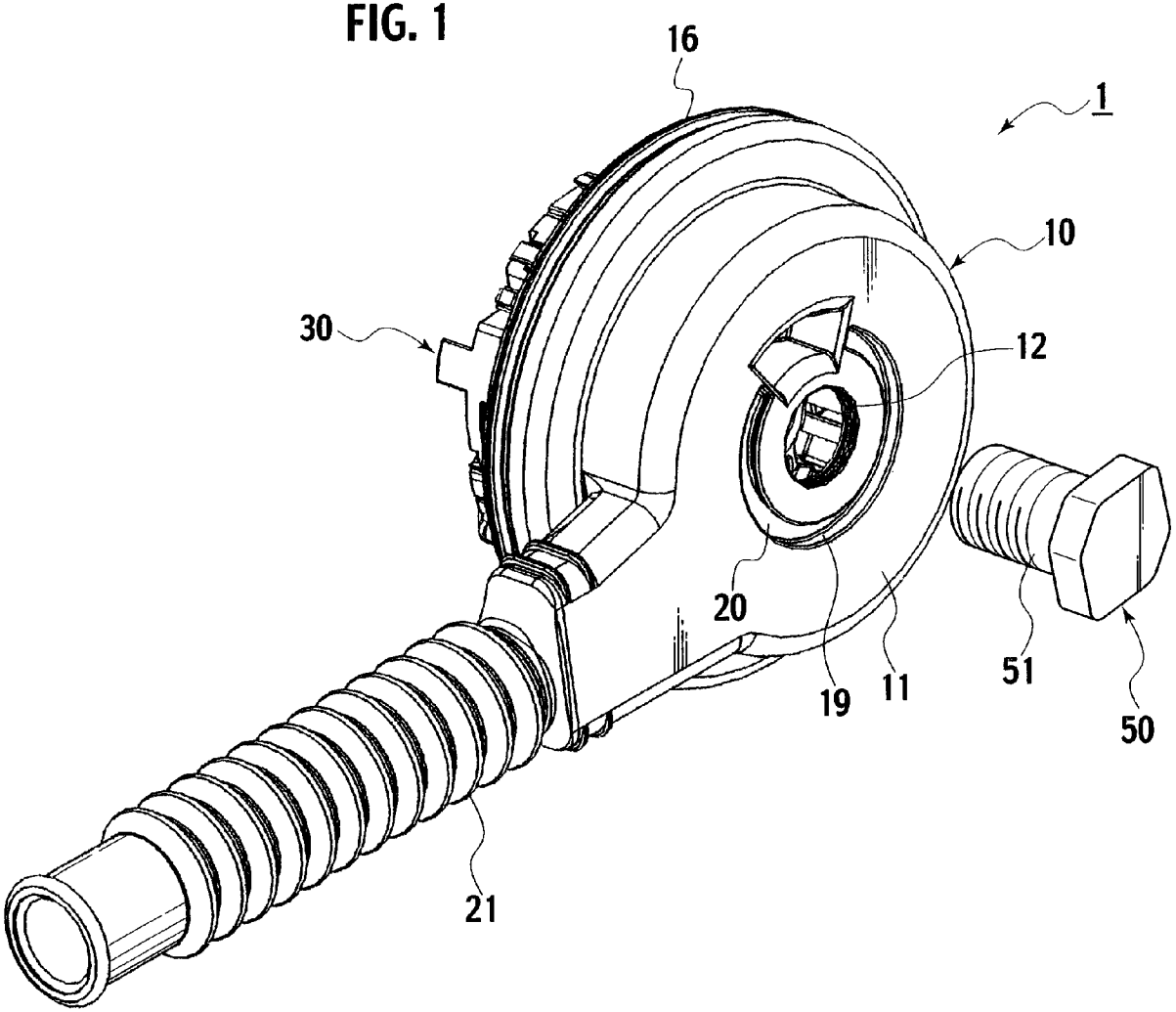
FIG. 1 is a perspective view of a waterproof connector in accordance with an embodiment of the present invention, viewed from one side arranging a grommet.

Referring to accompanying drawings, a waterproof connector in accordance with one embodiment of the present invention will be described in detail, below. In the drawings, identical or similar elements are indicated with same or similar reference numerals, respectively. However, it should be noted that the drawings are typical ones and therefore, there are differences between elements in the drawings and actual elements, in terms of the relationship of each element between its thickness and dimensions in plan view, the percentage of a thickness of each layer, and so on.

Figure 2:
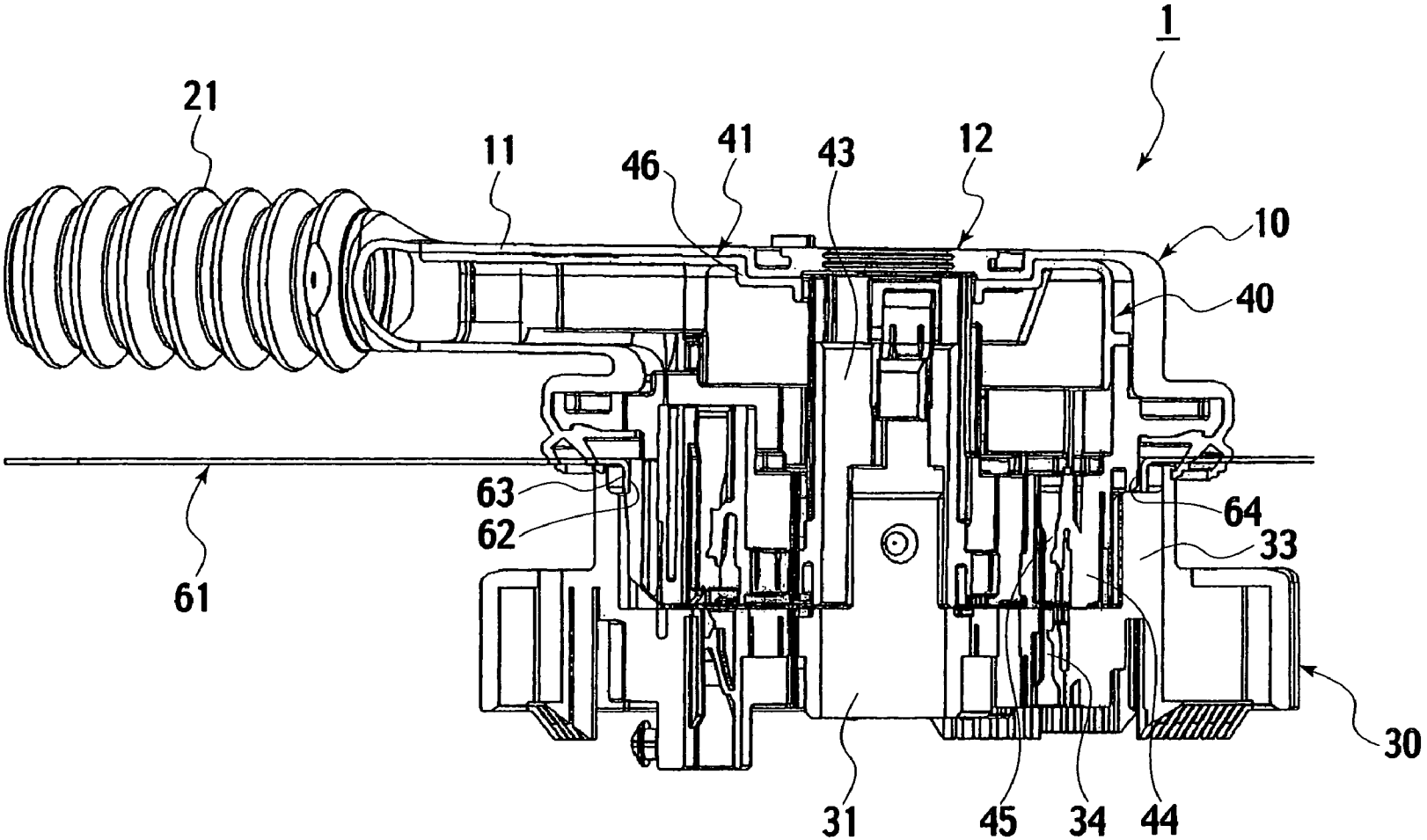
FIG. 2 is a sectional view of the waterproof connector in accordance with the embodiment of the present invention.
Figure 3:
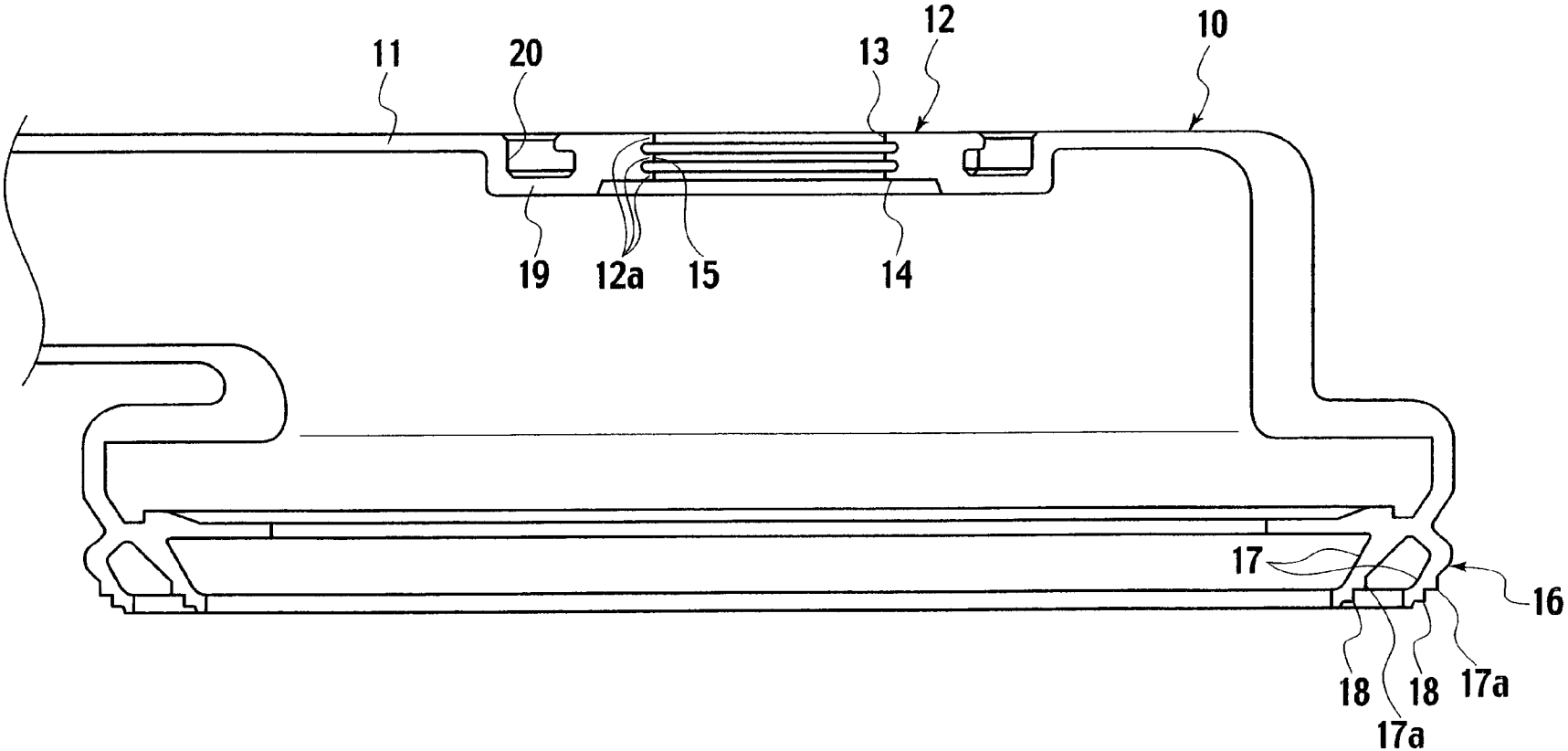
FIG. 3 is a sectional view of a substantial part of the grommet of the waterproof connector in accordance with the embodiment of the present invention.

FIG. 1 is a perspective view of a waterproof connector 1 in accordance with this embodiment, viewed from one side arranging a grommet. FIG. 2 is a sectional view of the waterproof connector 1 in accordance with the embodiment. FIG. 3 is a sectional view of a substantial part of the grommet in accordance with the embodiment.

As shown in FIGS. 1 to 3, the waterproof connector I of this embodiment includes a male housing 30 as one connector housing and a female housing 40 as another connector housing. The male housing 30 and the female housing 40 are arranged on both sides of a panel 61 respectively and furthermore, a terminal 34 of the male housing 30 and a terminal 45 of the female housing 40 are connected with each other through a mounting hole 62 formed in the panel 61.

The mounting hole 62 is provided with a circular ring part 63 having a substantially-cylindrical configuration. The circular ring part 63 is provided, on its inner periphery, with an inner peripheral surface 64 forming an inner peripheral surface of the mounting hole.

Again, the male housing 30 and the female housing 40 have terminal accommodating parts 33, 44 formed in their central portions, respectively. Thus, the connection between the terminals 34, 45 are accomplished by inserting the terminal accommodating part 44 of the female housing 40 into the terminal accommodating part 33 of the male housing 30. Additionally, the female housing 40 is provided, at a central portion of the terminal accommodating part 44, with a fastening-member accommodating chamber 43. In the male housing 30, the terminal accommodating part 33 is provided, at its central part, with a female screw part 31 as a fastener receptor. When a bolt 50 as a fastening member penetrates the fastening-member accommodating chamber 43 and screw-engages with the female screw part 31, the male housing 30 is fastened to the female housing 40.

The grommet 10 mainly includes a grommet body 11, a bellows part 21, a panel abutting part 16, a bolt sealing part 12 and an engagement extension part 19 and is provided by integral molding using material having both elasticity and flexibility, such as synthetic rubber.

The grommet body 11 is fitted to the female housing 40 so as to cover a backside 41 of the terminal accommodating part 44 of the female housing 40.

The bellows part 21 is formed integrally with the grommet body 11 while maintaining a cylindrical shape in the form of a bellows having elasticity. Inserted into the bellows part 21 is a harness (not shown) that extends from a terminal 45 accommodated in the terminal accommodating part 44 of the female housing 40.

The panel abutting part 16 is shaped to be a substantially-circular ring and comprises two pieces of ribs 17 each of which is formed so that the above circular ring has a radius reduced gradually as proceeding from its base end toward the tip. Further, the panel abutting part 16 is formed integrally with the grommet body 11 so as to compass the outer circumference of the terminal accommodating part 44. Each rib 17 has a projection 18 formed on a rib's surface 17*a* on the side of the panel 61. Additionally, the panel abutting part 16 is formed so as to lie outside the mounting hole 62 when attaching the waterproof connector 1 to the panel 61. Thus, when interposing the panel 61 between the male housing 30 and the female housing 40, the panel abutting part 16 gets in touch with the panel 61 and is elastically deformed to prevent water from being influent from the outside.

A bolt sealing part 12 is shaped to be a substantial cylinder having an inner diameter somewhat smaller than a shaft part 51 of the bolt 50 to be inserted and a predetermined length along a direction to insert the bolt 50. Further, an inlet side end part 13, which constitutes an inserting part into which the bolt 50 as the fastening member, is formed thickly in comparison with an outlet side end part 14. Again, the inlet side end part 13 is formed integrally with the grommet body I1 through the engagement extension part 19 on the outer peripheral side of the outlet side end part 14. Additionally, the bolt sealing part 12 is provided, on its inner peripheral surface 15, with a plurality of circular ribs 12*a*, allowing the bolt sealing part to stick fast to the shaft part 51.

The engagement extension part 19 as an extension part is formed integrally with the bolt sealing part 12 and the grommet body 11, having an ancyroid section therebetween. In appearance, the engagement extension part 19 is disposed as an annular groove part 20 as an outer peripheral part compassing the bolt sealing part 12. Again, the engagement extension part 19 as an engagement part is adapted so as to be engageable with an annular step part 46 as an engagement part of the female housing 40 on condition that the bellows part 21 is pulled.

As the grommet 10 is provided with such a configuration, the grommet 10 is prevented from being deformed due to tension escaping from the absorption of the bellows part 21 since the annular step part 46 engages with the engagement extension part 19. In addition, if the bellows part 21 is further pulled, the engagement extension part 19 absorbs tension due to deformation of the part 19, while the outlet side end part 14 of the bolt sealing part 12 absorbs tension escaping from the absorption of the engagement extension part 19 due to deformation of the part 14, establishing a seal between the inlet side end part 13 and the shaft part 51 of the bolt 50.

As mentioned above, the waterproof connector 1 of this embodiment is provided with the bolt sealing part 12 which has a predetermined length along the inserting direction of the bolt 50 and which is formed, at the outlet side end part 14, integrally with the grommet body 11. Therefore, even if the grommet body 11 is pulled in the processes of wiring the harness and attaching the waterproof connector 1 to the panel 61, the inlet side end part 13 is maintained as being sealed up, excluding the possibility that the waterproofing performance deteriorates.

Additionally, owing to the engagement of the engagement extension part 19 with the annular step part 46, even if the grommet body 11 is pulled, the sealing part 12 is maintained as being sealed up, excluding the possibility that the waterproofing performance deteriorates.

Further, owing to the provision of the engagement extension part 19 between the bolt sealing part 12 and the grommet body 11, even if the grommet body 11 is pulled, the engagement extension part 19 operates to absorb such a pulling. Thus, the pulling has less effect on the bolt sealing part 12, so that the inlet side end part 13 is maintained as being sealed up, excluding the possibility that the waterproofing performance deteriorates.

It is noted that the bolt 50 is employed as the fastening member in this embodiment. Instead, an adoption of alternative means (e.g. fastener, cam structure, etc.) that has a similar shape to the shaft part 51 of the bolt 50 and that can give an assurance of sufficient fastening force while simplifying a worker's fastening operation would effect similarly to the bolt 50.

It is noted that, in this embodiment, a structure where the engagement extension part 19 as one engagement part is engaged with the annular step part 46 as the other engagement part prevents the grommet 10 from being misaligned. Alternatively, the prevention of misalignment in the grommet 10 could be attained by forming a rib or the like on the inner peripheral surface of the annular step part 46 and further allowing the so-formed rib to engage with the engagement extension part 19.

As stated above, we describe the present invention by way of its embodiment. However, the present invention is not limited to this and therefore, constitution of respective parts may be replaced by optional constitutions having similar functions to those of the parts.

INDUSTRIAL APPLICABILITY

The present invention can provide a waterproof connector that does not deteriorate its waterproof performance between a fastening member and a sealing part despite that a grommet body is pulled.

The invention claimed is:

1. A waterproof connector comprising:

a first connector housing;

a second connector housing fitted to the first connector housing;

a grommet configured to cover at least one of the first connector housing and the second connector housing; and a fastening member inserted from a side of the grommet to connect the first connector housing with the second connector housing, wherein the grommet is formed with a predetermined length along the inserting direction of the fastening member and includes a sealing part formed integrally with the grommet at a grommet's part into which the fastening member is to be inserted, and wherein the sealing part includes an outer surface and is provided, on an outer peripheral part thereof, with an annular groove defined, at least in part, by an engagement extension part recessed from the outer surface of the sealing part in the inserting direction of the fastening member, the engagement extension part absorbing a tension when the grommet is pulled.

2. The waterproof connector of claim 1, wherein at least one of the first connector housing and the second connector housing is provided with an engagement part, and the sealing part is provided, on an outer peripheral part thereof, with a catching part for engagement with the engagement part.

* * * * *